US006264347B1

(12) United States Patent
Godbillon et al.

(10) Patent No.: US 6,264,347 B1
(45) Date of Patent: Jul. 24, 2001

(54) INDICATING LIGHT WITH HOMOGENEOUS ILLUMINATION, INCLUDING SMOOTH ZONES

(75) Inventors: Vincent Godbillon, Paris; Jean Claude Gasquet, Saint Clement; Christian Montelymard, Saint Gratien, all of (FR)

(73) Assignee: Valeo Vision, Bobigny Cedex (FR)

( * ) Notice: Subject to any disclaimer, the term of this patent is extended or adjusted under 35 U.S.C. 154(b) by 0 days.

(21) Appl. No.: 09/374,416

(22) Filed: Aug. 13, 1999

(30) Foreign Application Priority Data

Aug. 14, 1998 (FR) ..... 98 10426

(51) Int. Cl.[7] ..... F21V 5/00

(52) U.S. Cl. ..... 362/331; 362/332; 362/328; 362/521

(58) Field of Search ..... 362/520, 521, 362/522, 331, 327, 328, 332, 339; 359/742

(56) References Cited

U.S. PATENT DOCUMENTS 4,814,950 * 3/1989 Nakata ..... 362/61
4,859,043 8/1989 Carel et al. .
5,081,564 * 1/1992 Mizoguchi et al. ..... 362/61
5,158,350 * 10/1992 Sato ..... 362/61
5,580,165 12/1996 Natsume et al. .
5,603,561 2/1997 Ohishi .

FOREIGN PATENT DOCUMENTS 91 11 339 10/1991 (DE) .
2 614 969 11/1988 (FR) .

* cited by examiner

*Primary Examiner*—Sandra O'Shea
*Assistant Examiner*—John Anthony Ward
(74) *Attorney, Agent, or Firm*—Morgan & Finnegan, LLP

(57) ABSTRACT

A rear indicating light for a motor vehicle comprises a light source, a bonnet in front of the light source, and an optical plate in front of the bonnet. The bonnet has means for distributing essentially uniformly the radiation it receives from the light source, over at least part of the surface of the flat optical plate, which is formed with striations to align the radiation along the optical axis. These striations are grouped in at least one discrete zone on the surface of the plate, the remainder of this surface consisting of at least one optically neutral zone, while the distributing means are adapted to distribute at least some of the radiation from the light source towards the discrete striated zones.

8 Claims, 3 Drawing Sheets

INDICATING LIGHT WITH HOMOGENEOUS ILLUMINATION, INCLUDING SMOOTH ZONES

FIELD OF THE INVENTION

The present invention relates to indicating lights of the kinds which are generally fitted to the rear of motor vehicles, for emitting light in essentially a single direction.

BACKGROUND OF THE INVENTION

Until recent years, the majority of indicating lights had the disadvantage that they provided a field of illumination which was not at all homogeneous, despite various devices for spreading the light which are in use at the present time, and which generally consist of billets or toroids incorporated in the cover glass or in an optical plate, or screen, of the indicating light. This disadvantage, which is in general tolerable from the point of view of conforming with the law, is a definite drawback from the aesthetic point of view, while homogeneity of the fields of illumination of the indicating lights is a matter which is now considered to be of increasing importance.

It is known from the French published patent document No. FR 2 614 969A to provide an indicating light with a homogeneous field of illumination. This indicating light includes, within a housing, an optical screen which is transparent or translucent and which is referred to as a "bonnet", being interposed between a light source and an essentially flat optical screen or plate which is set at right angles to the optical axis of the indicating light. The particular geometrical configuration of the bonnet ensures that the surface density of the light flux arriving on the flat optical plate is substantially constant over the whole surface of the optical plate. Finally, the surface of the optical plate is provided with striations which align the light rays received from the bonnet, in order to transmit outside the indicating light a beam consisting of rays parallel to the optical axis of the light itself.

The homogeneity of lighting provided by such an indicating light thus provides an aesthetic advantage by comparison with previous arrangements. However, the striations which are carried by the flat optical plate do not enable light to penetrate into the indicating light, and consequently an observer looking at the light from outside will only see an opaque surface. Now, a current tendency in matters of styling for automobile indicating lights lies in the design of such lights so that they have a so-called "glassy" appearance, smooth and transparent, such that what an outside observer is able to perceive (whether it be what he really sees or whether it be an illusion) is a certain amount of depth in the hollow interior or cavity of the indicating light.

DISCUSSION OF THE INVENTION

An object of the present invention is to improve the aesthetic appearance of existing indicating lights, by proposing an indicating light which not only has a field of illumination of homogeneous intensity, but which also gives an impression of depth when extinguished and observed from outside.

According to the invention, an indicating light comprising a light source, a bonnet and an optical plate, the bonnet having means for distributing, essentially uniformly, radiation (which has been received from the light source) over at least part of the surface of the optical plate, the optical plate having striations for aligning the radiation in the direction of the optical axis of the indicating light, is characterised in that the striations an the said optical plate are arranged in at least one discrete zone of the surface of the optical plate, with the remainder of the surface of the latter consisting of at least one optically neutral zone, and in that the distributing means are adapted to direct at least part of the radiation issued from the light source towards the said discrete striated zones.

According to a preferred feature of the invention, the distributing means are adapted to pass essentially all of the radiation issued from the light source only towards the discrete striated zone or zones of the optical plate.

A reflector may also be provided, for reflecting part of the radiation from the light source directly towards the optical plate. This reflector is adapted to pass essentially all of the radiation from the light source towards the optically neutral zone or zones of the optical plate.

The optical plate may constitute a closure glass for the indicating light.

The optically neutral zones of the optical plate are preferably smooth.

The optically neutral zones of the optical plate may include surfaces having a reduced curvature, chosen in such a way as to enable the depth of the indicating light behind the optical plate to be perceived visually from outside.

The optical plate preferably includes a plurality of optically neutral zones arranged alternately with striated zones.

Further features and advantages of the invention will appear more clearly on a reading of the following detailed description of some preferred embodiments of the invention, which is given by way of non-limiting example only and with reference to the accompanying drawings.

DESCRIPTION OF PREFERRED EMBODIMENTS OF THE INVENTION

Figure 1:
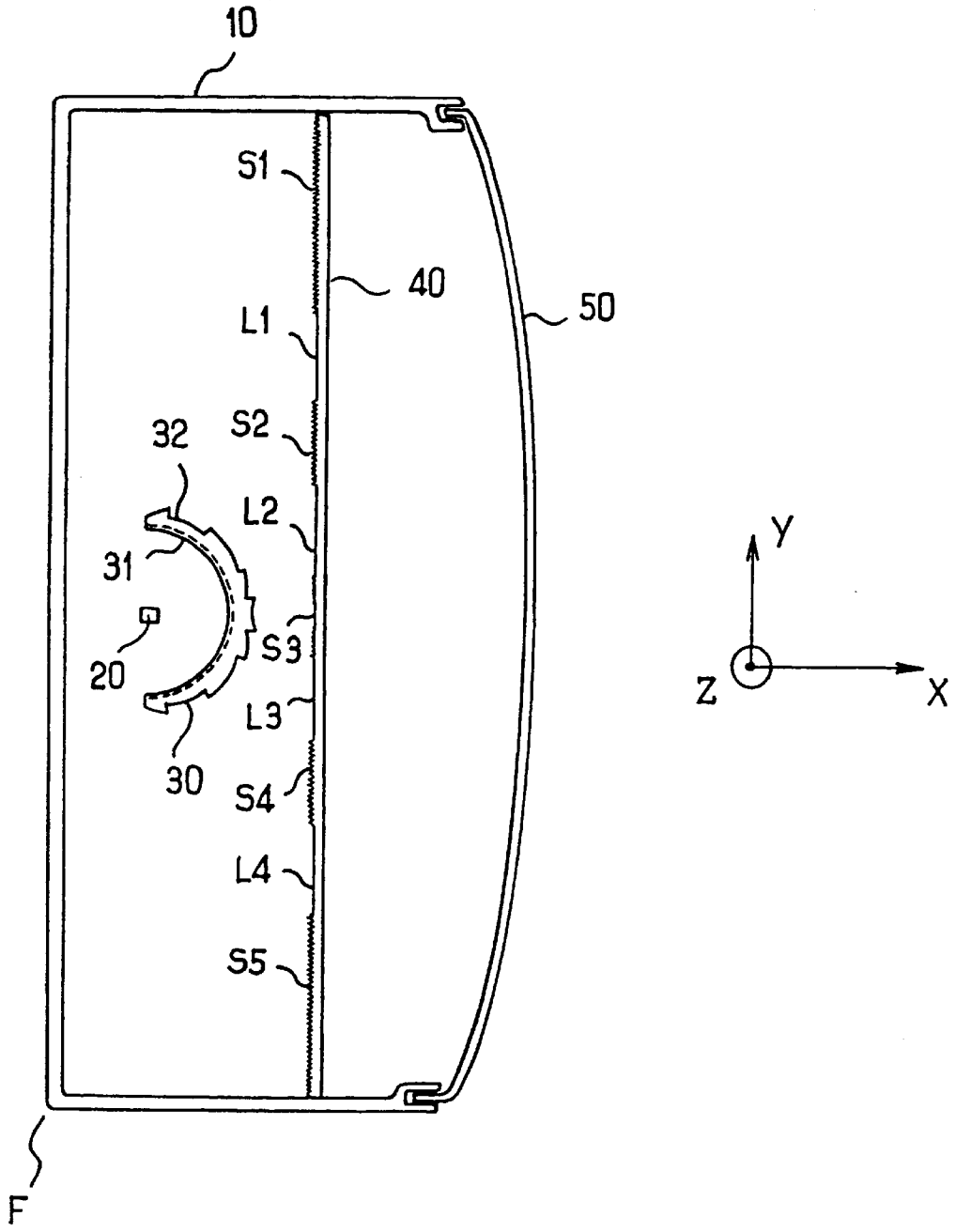
FIG. 1 is a diagrammatic view in horizontal cross section of a first embodiment of an indicating light in accordance with the invention, for a motor vehicle.

In the description that follows, three orthogonal directions X, Y and Z are defined which will be used in the drawings, X being the direction of the optical axis of the indicating light to be described, and Y and Z being the horizontal and vertical directions respectively.

With reference first of all to FIG. 1, this shows an indicating light F which includes, in a housing 10, a light source such as a filament lamp 20, a curved screen or bonnet 30, and a flat screen or optical plate 40. The housing 10 of the light is closed by a smooth cover glass 50. The bonnet 30, which is of a kind known per se from the French patent document FR 2 614 969A, carries, on its inner face 31, striations which extend generally in the horizontal direction Y, for aligning the radiation issued from the light source 20, and such that this radiation will essentially cover the whole vertical extent of the optical plate 40. As to the external face 32 of the bonnet 30, this is formed with further striations, which extend this time in the generally vertical direction Z, so as to distribute over the optical plate 40, substantially uniformly in the horizontal direction Y, the rays from the light source 20. Thus each unit of surface area of the optical plate 40 receives the same radiation intensity, in accordance with the known properties of the bonnet 30.

The optical plate 40 is so designed that it will carry out the following two functions, namely:

- firstly, when the indicating light is lit, the plate 40 will align at least part of the light rays issued from the bonnet 30, so as to deliver, outside the indicating light, an indicating light beam which conforms to current regulations. From an aesthetic point of view the illumination produced by the optical plate 40 in the direction X of the optical axis of the light must also be homogeneous in the YZ plane at right angles to the optical axis X; and
- secondly, when the indicating light is extinguished, the optical plate 40 will offer to an outside observer an appearance of depth in order to respond to the above mentioned aesthetic objective.

To this end, the optical plate 40 is divided into zones S1 to S5 which are striated and which are disposed alternately with smooth zones L1 to L4. The striations in the zones S1 to S5 are adapted to align the light rays issued from the bonnet 30 along the optical axis X of the indicating light. Thus, the rays from the light source 20, which are directed by the bonnet 30 towards the respective striated zones S1 to S5, are aligned in the direction of the optical axis X by these striations. The closure glass 50 being essentially smooth, it does not divert the light rays that pass through it, and the indicator light, when lit, therefore passes to the outside parallel beams which follow the optical axis X, and which appear to be derived from the zones S1 to S5. In addition, the light flux arriving on the striated zones S1 to S5 of the optical plate 40 being uniform as has been mentioned, the field of illumination constituted by the zones S1 to S5 is homogeneous.

Because the zones L1 to L4 are essentially smooth, light from outside is able to penetrate into the indicator light by passing through the zones L1 to L4, when the light F is extinguished. It therefore has optically neutral zones L1 to L4, through which an observer is able to see the depth of the indicator light, and which have a smooth glassy aspect which is particularly attractive from the aesthetic point of view.

Figure 2:
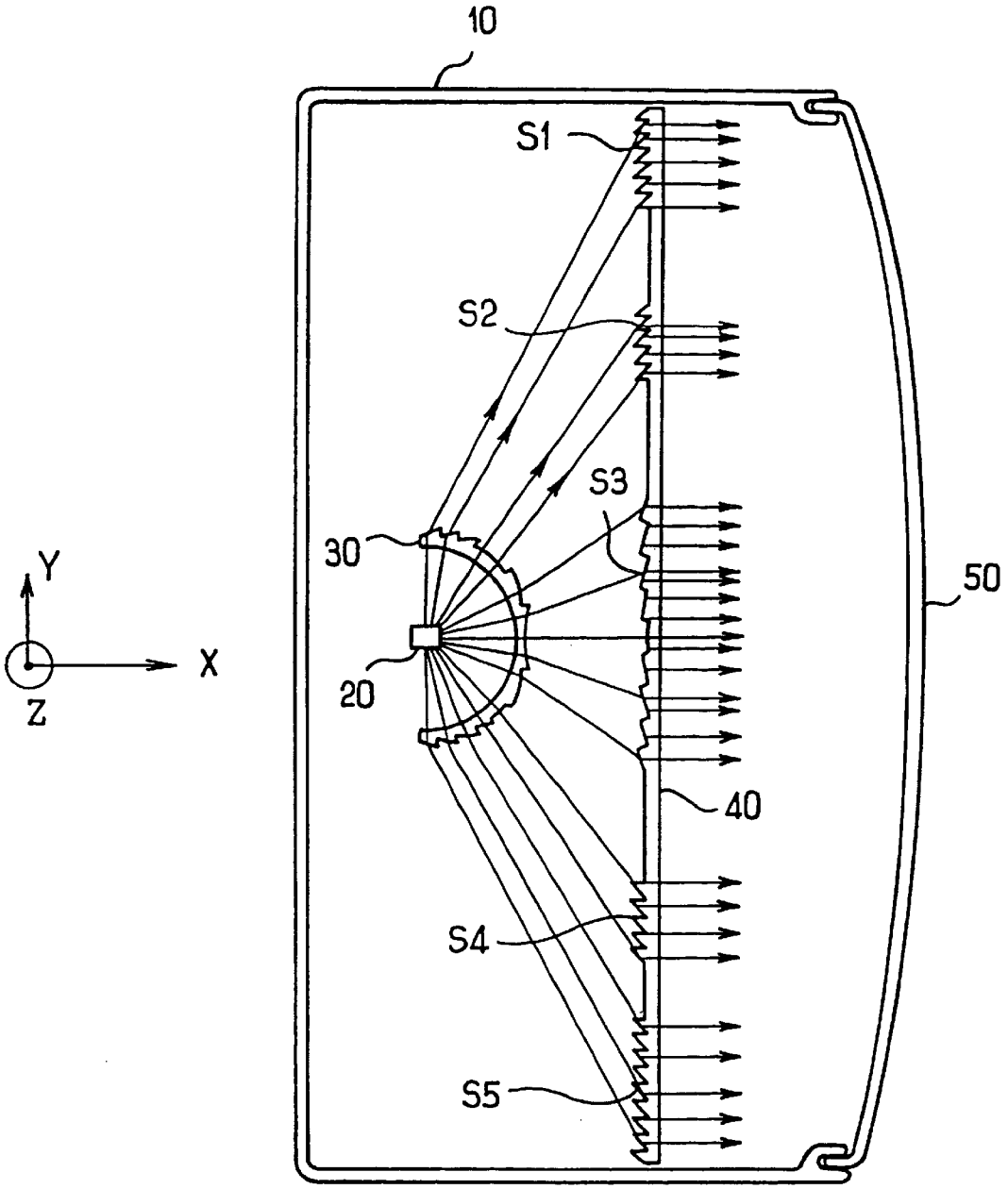
FIG. 2 is a view of the same indicating light as in FIG. 1, but illustrates the path followed by part of the light rays when the light is lit.

Thus, the indicator light has all of the following features, that is to say:

- it has a glassy aspect in the smooth zones L1 to L4, satisfying the aesthetic requirements; and
- it provides lawful illumination over a homogeneous field of illumination coming from the striated zones S1 to S5, as is illustrated in detail in FIG. 2, which diagrammatically shows the path followed by that part of the light rays that comes from the bonnet 30 and is directed towards the striations in the zones S1 to S5.

In the case of the indicating light shown in FIGS. 1 and 2, a part (not shown in FIG. 2) of the radiation coming from the bonnet 30 is directed towards the smooth zones L1 to L4. Since this radiation is not diverted either by the smooth zones or by the cover glass 50, which is optically neutral, it is not made use of in the main function of the indicating light, which is to provide illumination in a direction parallel to the optical axis X.

Figure 3:
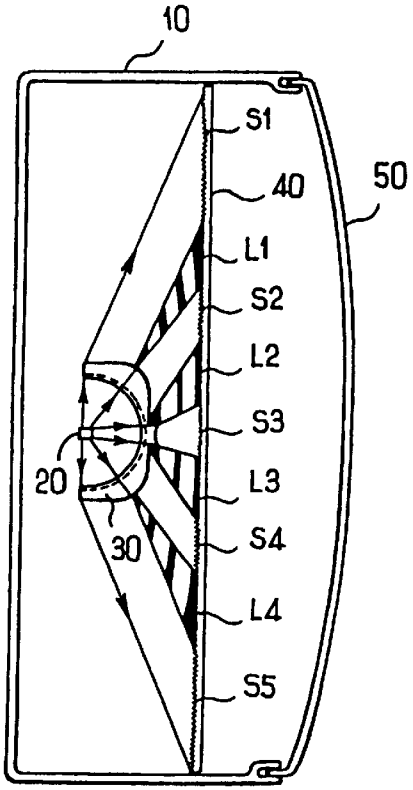
FIG. 3 is a diagrammatic view in horizontal cross section of a first modified version of the indicating light in accordance with the invention, showing the path followed by the light rays when the light is lit.

Accordingly, and with reference now to FIG. 3, the indicating light of FIGS. 1 and 2 may be modified as shown in FIG. 3, in which the striations carried by the two faces of the bonnet 30 are adapted so as to direct most of the radiation issued from the light source 10 towards the striated zones S1 to S5 of the optical plate 40. Such an adaptation, which can be easily performed by a person skilled in this technical field with appropriate simple geometrical calculations which can be carried out on a computer or other similar means, enables essentially all of the light issued from the light source to be able to participate in the illumination in the direction of the optical axis. The useful flux of the indicating light is in this way substantially increased.

FIG. 3 thus illustrates the adaptation of the vertical striations on the outer face 32 of the bonnet, so as to distribute, in the horizontal direction Y over the striated zones S1 to S5 of the optical plate 40, essentially all of the rays coming from the light source 20. In FIG. 3, the hatched angular sectors between the bonnet 30 and the optical plate 40 correspond to the zones through which the radiation from the bonnet 30 does not pass.

It is also possible to adapt, according to the same principle, the horizontal striations on the inner face 31 of the bonnet, thereby distributing the essential part of the rays from the light source over specific zones in the vertical direction Z.

Figure 4:
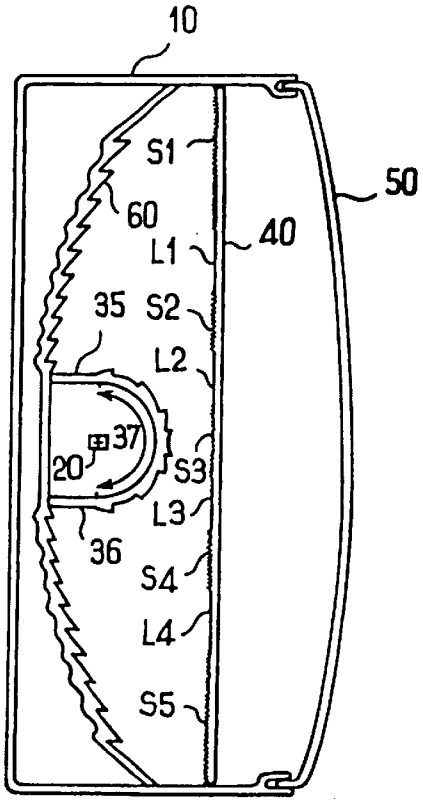
FIG. 4 is a diagrammatic view in horizontal cross section showing a second modified embodiment of the indicating light in accordance with the invention.

Reference is now made to FIG. 4, which shows a second modified embodiment of an indicating light in accordance with the invention. Here again, a bonnet 30 is interposed between a light source 20 and an optical plate 40 similar to that in FIG. 1. This particular embodiment is specific to the fact that here, some of the radiation from the light source passes through optically neutral portions 35 and 36 of the bonnet 30, so as to be incident on the walls of a reflector 60 which carries the bonnet 30 and the light source 20. The geometry of the reflector 60 is preferably that of a paraboloid of revolution focused on the light source 20, with the surface elements of the reflector being offset in the manner of Fresnel echelons, thereby limiting the depth of the indicating light. The rays reflected by the walls of the reflector are thus diverted towards the optical axis X and reach the optical plate 40 in a reasonably uniform surface intensity and in a direction close to the axis X.

The zone 37 of the bonnet repeats the geometry of the bonnet shown in FIG. 1. In another version, not shown in the drawings, this zone 37 can be modified in a similar way to the bonnet of FIG. 3, so as to direct the radiation passing through it essentially towards the striated zones S1 to S5. In that case, the geometry of the walls of the reflector 60 is also adapted so as to reflect towards the smooth zones L1 to L4 essentially all of the radiation coming from the zones 35 and 36, so that the indicating light emits in the direction of the optical axis X radiation which is substantially homogeneous over its whole surface.

The advantage of the version which makes use of a reflector is that it enables a greater proportion of the light flux from the light source to be recuperated, with some of the rays emitted by the source 20 in the half plane opposite to the optical plate 40 being recuperated and redirected towards the optical plate, thereby making a useful contribution to the light beam along the optical axis X.

Figure 5:
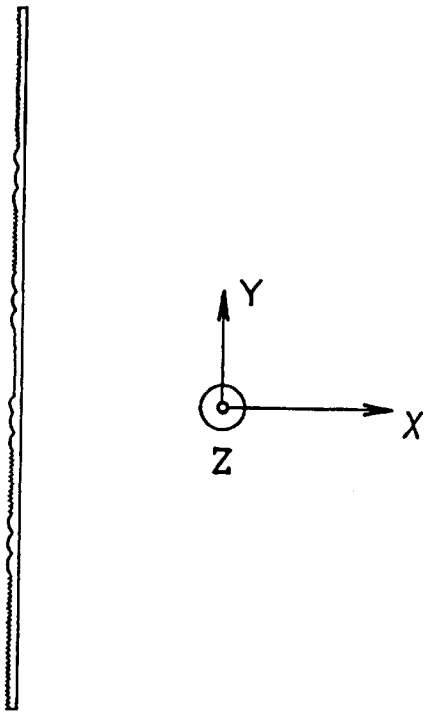
FIG. 5 is a diagrammatic view in horizontal cross section showing a modified version of the optical plate of the light according to the invention.

Referring now to FIG. 5 which shows a modified version of the optical plate 40, this version makes use of one particular aesthetic feature of the zones L1 to L4, in which these zones are not totally smooth, but comprise cylinders of large radius. In this version, which is an alternative in styling terms, the zones L1 to L4 remain optically neutral, since the radius of the cylinders is chosen to be large enough to produce no more than negligible diversion of the light rays during their passage through the cylinders. In this way an appearance of depth is preserved in part of the surface of the indicating light.

The striated zones S1 to S5 of the indicating light of FIGS. 1 and 2 extend in the vertical direction Z. However, it will be very clear that the invention is not limited to that particular configuration. In particular, the striated zones on the one hand, and the optically neutral zones on the other hand, may constitute, over the surface of the optical plate 40, any kind of geometrical motifs, for example straight or curved bands, according to the aesthetic effect called for. The choice and disposition of the optically neutral zones determines the form and aspect of the zones of the housing of the indicating light which can be seen through the cover glass and the optical plate. In the case of an indicating light in which essentially all of the light from the light source must be directed towards the striated zones, a person skilled in this technical field will be able to adapt the geometry of the striations of the inner and outer faces of the bonnet 30 according to the distribution of the smooth and striated zones of the optical plate 40.

Finally, the optical plate 40 may equally perform the function of cover glass for the indicating light, and means may be provided for spreading light that emanates from the optical plate 40 both in width and in height, in accordance with regulations.

What is claimed is:

1. An indicating light defining an optical axis and comprising: a light source; a bonnet in front of the light source; and an optical plate in front of the bonnet, the optical plate having a light receiving surface facing the bonnet, the bonnet having distributing means for distributing radiation received by the bonnet from the light source, substantially uniformly over at least part of the said surface of the optical plate, the optical plate having striations on said surface for aligning the radiation received from the bonnet in the direction of the optical axis, wherein the striations on the optical plate are grouped in at least one discrete zone thereby defined on the said surface, the remainder of the said surface comprising at least one optically neutral zone, the said distribution means being adapted to direct at least part of the radiation received from the light source towards the said discrete striated zones.

2. A light according to claim 1, wherein the said distribution means are adapted to pass substantially all of the radiation from the light source only towards the said at least one striated discrete zone of the optical plate.

3. A light according to claim 1, further including a reflector disposed behind the optical plate for reflecting part of the radiation from the light source towards the optical plate.

4. A light according to claim 3, wherein the said reflector is adapted to send substantially all of the radiation from the light source towards the said at least one optically neutral zone of the optical plate.

5. A light according to claim 1, wherein the optical plate constitutes a closure glass of the light.

6. A light according to claim 1, wherein the said at least one optically neutral zone of the optical plate is smooth.

7. A light according to claim 1, wherein the said at least one optically neutral zone of the optical plate comprises surfaces of a reduced curvature such as to enable the depth of the indicating light behind the optical plate to be perceived visually from outside.

8. A light according to claim 1, wherein the optical plate includes a plurality of optically neutral zones disposed alternatively with striated zones.

* * * * *